US007297034B1

(12) United States Patent
Wieland et al.

(10) Patent No.: US 7,297,034 B1
(45) Date of Patent: Nov. 20, 2007

(54) HIGH CURRENT SEALED CONNECTION SYSTEM

(75) Inventors: Andrew Dean Wieland, Fargo, ND (US); Jeffrey Gerald Hopman, Horace, ND (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/526,791

(22) Filed: Sep. 25, 2006

(51) Int. Cl.
*H01R 4/38* (2006.01)

(52) U.S. Cl. ..... 439/801; 439/83

(58) Field of Classification Search ..... 439/78, 439/83, 801; 361/714
See application file for complete search history.

(56) References Cited

U.S. PATENT DOCUMENTS 4,219,251 A * 8/1980 Romine ..... 439/692
4,614,387 A * 9/1986 Hartl ..... 439/70
4,625,260 A * 11/1986 Jordan et al. ..... 361/720
4,717,989 A * 1/1988 De Barros et al. ..... 361/818
5,439,398 A * 8/1995 Testa et al. ..... 439/801
5,655,931 A * 8/1997 Perugini ..... 439/573
6,111,760 A * 8/2000 Nixon ..... 361/814
6,142,836 A * 11/2000 Deckmann et al. ..... 439/801
2001/0005658 A1* 6/2001 Matsuda et al. ..... 439/801

FOREIGN PATENT DOCUMENTS

DE 10215985 * 11/2003

* cited by examiner

*Primary Examiner*—Briggitte Hammond
*Assistant Examiner*—Larisa Tsukerman

(57) ABSTRACT

A circuit board assembly including a circuit board having at least one conductive element attached thereto and at least one surface mount stud carrier mounted on the circuit board and electrically connected to the at least one conductive element.

10 Claims, 2 Drawing Sheets

HIGH CURRENT SEALED CONNECTION SYSTEM

FIELD OF THE INVENTION

The present invention relates to a high current sealed connection system, and, more particularly, to a high current surface mount sealed connection system.

BACKGROUND OF THE INVENTION

For certain high power applications, typical through-hole type electronic components are attached to a printed circuit board. A typical application includes a threaded stud that is threaded through a circuit board. Such an assembly requires access to both sides of the board to pass the stud through the board and to make contact with the traces on the circuit board.

Another high power device known as a power tap includes a series of legs that extend through a printed circuit board and are soldered thereto. A surface portion of the power tap has a threaded hole through which a threaded connector, such as a screw, is threaded into the hole and a conductor is attached thereto. Such a device is not available in a surface mount version and cannot be used with a printed circuit board that is adhered directly to a heat sink.

What is needed in the art is a reliable way of connecting a printed circuit board to a heat sink yet having high current connections.

SUMMARY OF THE INVENTION

The present invention relates to a surface mount stud carrier having an environmental sealing system thereabout.

The invention comprises, in one form thereof, a circuit board assembly including a circuit board having at least one conductive element attached thereto and at least one surface mount stud carrier mounted on the circuit board and electrically connected to the at least one conductive element.

DETAILED DESCRIPTION OF THE INVENTION

Figure 1:
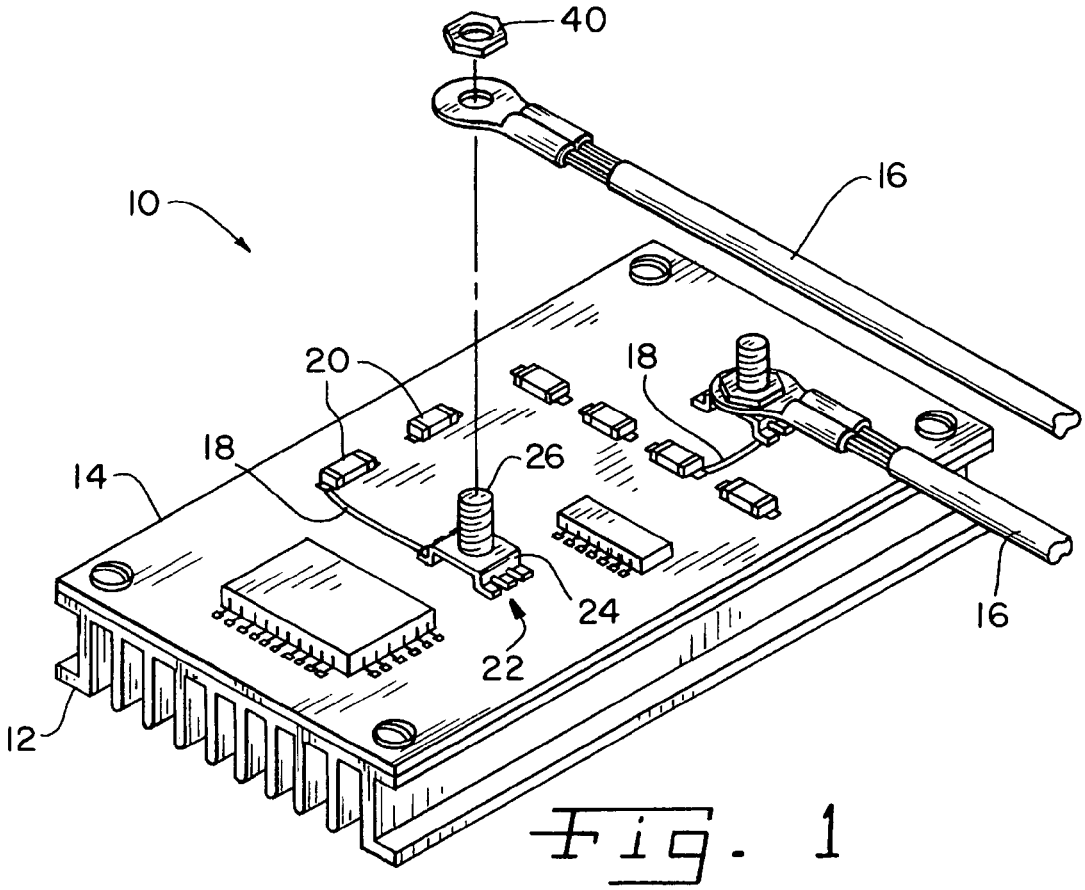
FIG. 1 illustrates an electrical assembly including an embodiment of a surface mount stud carrier of the present invention located thereon.

Referring now to the drawings, and more particularly to FIG. 1, there is shown an electronic assembly 10 including a heat sink 12, a printed circuit board 14 and conductors 16 being connected thereto. Heat sink 12 has a substantially flat surface beneath printed circuit board 14 for the conduction of heat from printed circuit board 14 to thereby increase the power handling capacity of electrical assembly 10. Conductors 16 are connected to electrical assembly 10 to convey power thereto and/or therefrom.

Printed circuit board 14 includes conductive elements 18 onto which surface mount components 20 are mounted. A surface mount stud assembly 22 is mounted to printed circuit board 14 and includes a surface mount stud carrier 24 and a stud 26 extending therethrough. Although surface mount stud carrier 24 and stud 26 have been illustrated as being separate devices, carrier 24 and stud 26 may be integrally formed. Surface mount stud carrier 24 has feet or pads which are soldered to conductive elements 18 on printed circuit board 14.

Figure 2:
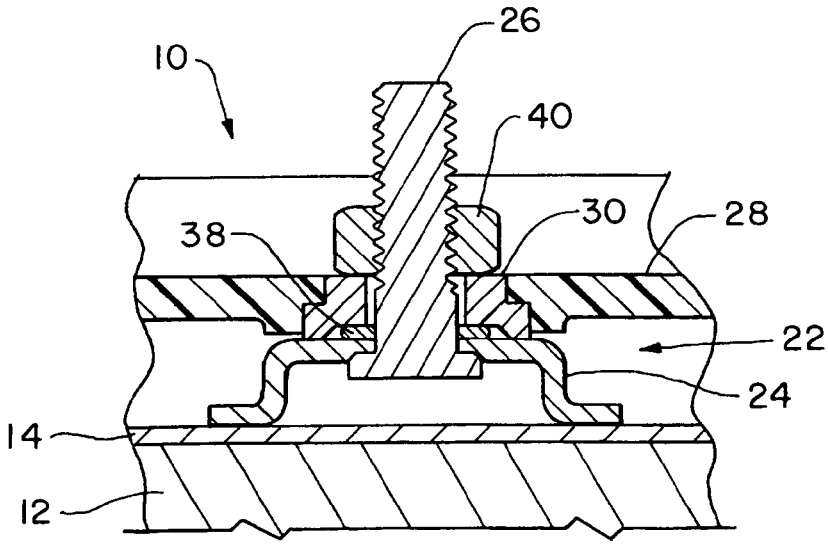
FIG. 2 is a cross-sectional view through one plane of the surface mount stud carrier of FIG. 1.
Figure 3:
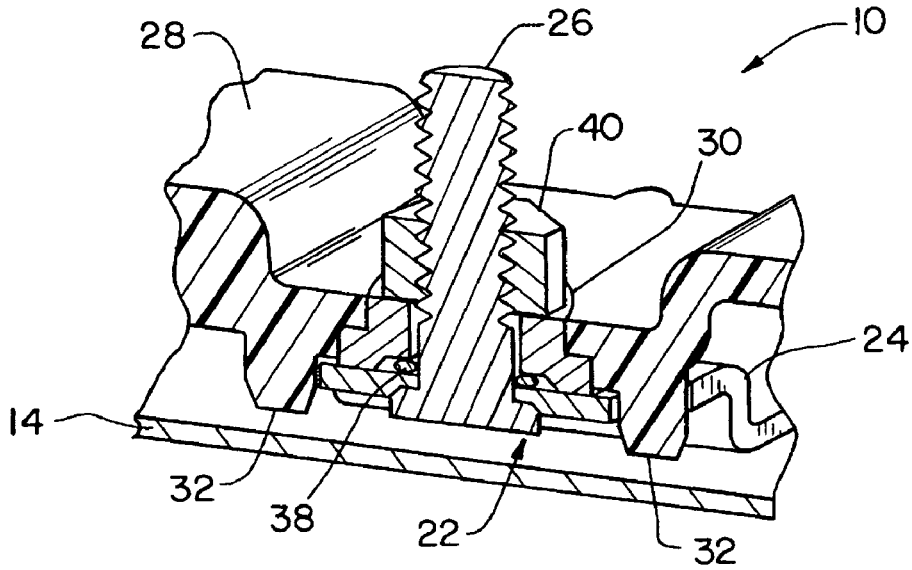
FIG. 3 is another cross-sectional view along another plane of the surface mount stud carrier of FIGS. 1 and 2.
Figure 4:
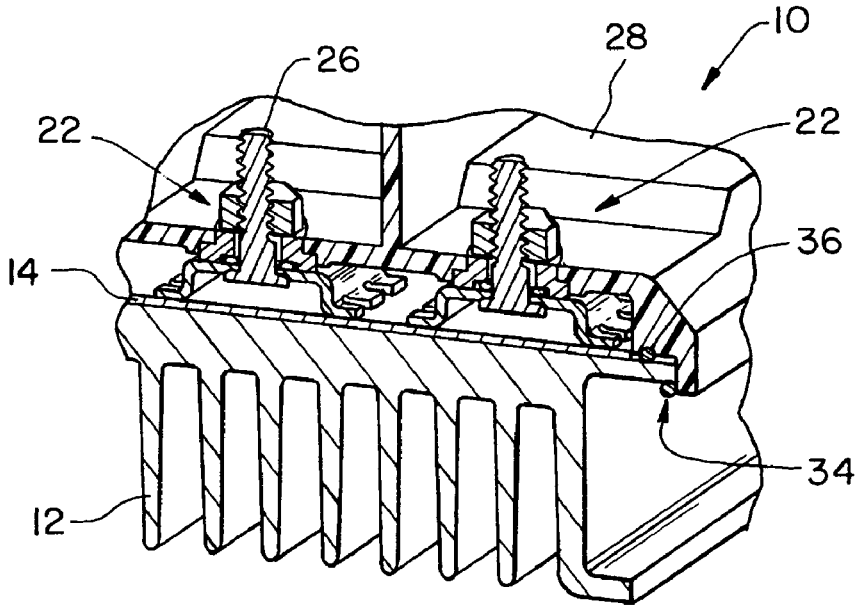
FIG. 4 is a perspective cross-sectional view of the stud carriers of FIGS. 1-3, mounted on an electrical assembly.

Now additionally referring to FIGS. 2-4, there is shown a housing 28 that substantially covers printed circuit board 14 with studs 26 extending through openings or holes in housing 28. Housing 28 was omitted from FIG. 1 for the purpose of illustrating the components that are placed on a surface of printed circuit board 14. Housing 28 includes inserts 30, bosses 32 and a snapping edge 34. Housing 28 is made from a non-conductive material, such as plastic, having inserts 30 molded thereinto. Insert 30 has a hole therethrough thereby allowing stud 26 to extend through the opening and to at least partially extend beyond a surface of housing 28. Bosses 32 extend from housing 28 and come into contact with a surface of printed circuit board 14 so as to reduce any compressive load placed on housing 28 from being transferred directly through surface mount stud carrier 24 to printed circuit board 14. Although bosses 32 are illustrated as straddling each side of surface mount stud carrier 24, other geometries and locations are contemplated. Bosses 32 come into contact with printed circuit board 14 so that forces that may be applied to a surface of housing 28 do not compromise the soldering of the feet of stud carrier 24.

A seal 36 extends around the perimeter of housing 28 and a compressive force is exerted thereonto when snap 34 engages a edge of heat sink 12 thereby holding housing 28 onto heat sink 12. Seal 36 provides an environmental seal to protect components 20, conductive elements 18 and any other contents of printed circuit board 14. Seal 36 may be removably attached to housing 28. Seal 36 is held under compression and deforms to provide sealing contact with printed circuit board 14.

Printed circuit board 14 may be adhered to heat sink 12 by way of an adhesive. Since no components are on the side of printed circuit board 14 that is in contact with heat sink 12 and no leads from a component extend through circuit board 14, intimate contact of board 14 with heat sink 12 is possible, thereby improving heat conduction from board 14 to heat sink 12. An adhesive may be used to hold printed circuit board 14 to heat sink 12. Alternatively, mechanical fasteners, such as screws can be used to hold board 14 to heat sink 12. Printed circuit board may also be held in place by way of a compressive force that occurs by the attachment of housing 28 to heat sink 12.

A seal 38 such as an o-ring 38 is positioned between surface mount stud carrier 24 and insert 30 to thereby seal housing 28 around the hole in insert 30. A nut 40 is threaded onto stud 26 thereby applying a compressive force through insert 30 to o-ring 38.

A conductor 16 may then be placed on stud 26 and another nut, not shown, can be threaded thereon, to hold conductor 16 in position on electrical assembly 10. Electrical assembly 10 advantageously allows for intimate contact of printed circuit board 14 with heat sink 12 thereby efficiently conducting heat therefrom. The present invention provides for a high power capacity of a printed circuit board without having to make provisions for through-hole components, which would extend beneath a circuit board.

Having described the preferred embodiment, it will become apparent that various modifications can be made without departing from the scope of the invention as defined in the accompanying claims.

The invention claimed is:

1. A circuit board assembly, comprising:

a circuit board having at least one conductive element attached to a first side thereto;

at least one surface mount stud carrier having a stud including a threaded portion extending therefrom mounted on the first side of the circuit board and electrically connected to said at least one conductive element;

a heat sink having that is in contact with a second side of the circuit board; and a non-conductive housing in at least partial contact with a surface of the circuit board, wherein said housing has an opening through which the stud at least partially extends and a snap feature that retainingly engages said heat sink.

2. An electrical assembly, comprising:

a surface mount stud carrier;

a stud having a threaded portion extending from said stud carrier;

a circuit board having at least one conductive element that is electrically connected to the surface mount stud carrier;

a heat sink having a surface that is in intimate contact with a side of the circuit board; and a non-conductive housing having an opening through which the stud at least partially extends, the housing having an opening through which the stud at least partially extends, the housing in at least partial contact with a surface of the circuit board, wherein said housing has a snap feature that retainingly engages said heat sink.

3. A circuit board assembly comprising:

a circuit board metalized on only a first side;

a heat sink secured to a second side of the circuit board;

a surface-mount stud connector having feet for securing to metalized conductive elements on the first side of the printed circuit board;

a stud having a threaded portion extending from the stud carrier the stud carrier preventing the stud from physically contacting the metalized surface of the circuit board; and a housing made of non-conductive material covering the circuit board, the housing having at least one insert molded thereinto, the insert having at least one opening extending therethrough allowing the stud to at least partially extend therethrough and project above the housing.

4. The circuit board assembly of claim 3 wherein the housing has a snap feature that retainingly engages the heat sink.

5. The circuit board assembly of claim 4 further comprising a seal around the perimeter of the housing, the seal forming an environmental seal with the first side of the printed circuit board when the snap engages the heat sink.

6. The circuit board assembly of claim 4 wherein the heat sink is held in place by way of a compressive forces that occurs by the attachment of the housing to the heat sink.

7. The circuit board assembly of claim 3 further comprising a compressive seal positioned between the insert and the surface mount stud carrier.

8. The circuit board assembly of claim 7 further comprising a threaded nut that engages the threaded portion of the stud and compresses the seal between the insert and the surface mount stud carrier.

9. The circuit board assembly of claim 3 wherein the heat sink is secured to the second side of the printed circuit board by way of an adhesive.

10. The circuit board assembly of claim 3 wherein the heat sink is secured to the second side of the printed circuit board by means of mechanical fasteners.

* * * * *